US006438344B1

(12) United States Patent
Fujimoto

(10) Patent No.: US 6,438,344 B1
(45) Date of Patent: Aug. 20, 2002

(54) DEVELOPER USED FOR ELECTROPHOTOGRAPHIC APPARATUS

(75) Inventor: Naoyuki Fujimoto, Hyogo (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/834,962

(22) Filed: Apr. 16, 2001

(30) Foreign Application Priority Data

Dec. 11, 2000 (JP) ..... 2000-376157

(51) Int. Cl.[7] ..... G03G 15/08
(52) U.S. Cl. ..... 399/254; 399/258
(58) Field of Search ..... 399/27, 61, 119, 399/252, 254, 255, 258, 260, 262, 263

(56) References Cited

U.S. PATENT DOCUMENTS 4,800,412 A * 1/1989 Ueda ..... 399/254
5,581,337 A * 12/1996 Suzuki ..... 399/263
5,722,002 A * 2/1998 Kikuta et al. ..... 399/258 X
5,943,537 A * 8/1999 Ahn ..... 399/254
6,006,050 A * 12/1999 Watanabe et al. ..... 399/61 X

FOREIGN PATENT DOCUMENTS

JP 63-187271 A * 8/1988
JP 01-276171 A * 11/1989
JP 7-134490 5/1995

* cited by examiner

*Primary Examiner*—Sandra Brase
(74) *Attorney, Agent, or Firm*—Armstrong, Westerman & Hattori, LLP

(57) ABSTRACT

A developer includes a toner container divided by a partition into first and second chambers. The first and the second chambers communicate with each other via first and second openings. A third opening is also formed in the partition for passing excessive toner from the second to the first chamber. The first chamber is provided with a first screw for transferring the toner from the first to the second opening, while the second chamber with a second screw for transferring the toner in the opposite direction. A toner scraping blade is arranged above the second screw. The toner scraped in the second chamber is led into the first chamber through the third opening. Adjusting means is provided for controlling the passage of the toner through the third opening, thereby achieving uniform toner distribution in the second chamber.

10 Claims, 10 Drawing Sheets

DEVELOPER USED FOR ELECTROPHOTOGRAPHIC APPARATUS

BACKGROUND OF THE INVENTION

1. Field of the invention

The present invention relates to a developer used for an electrophotographic image forming apparatus.

2. Description of the Related Art

An example of a conventional developer is shown in FIG. 9 of the accompanying drawings. The illustrated developer includes a toner container 1, a partition 2, first and second screws 3A–3B, a conveyor roller 4, a first toner blade 40, a second toner blade 50, and two developer rollers 5A–5B.

The space within the container 1 is divided into a first portion 10A and a second portion 10B by the partition 2. The first screw 3A is provided in the first portion 10A, while the second screw 3B is provided in the second portion 10B. The first toner blade 40 is arranged adjacent to the conveyor roller 4, while the second toner blade 50 is arranged adjacent to the first developer roller 5A. The toner contains magnetic particles or carriers.

Additional toner is supplied from a toner hopper 60 into the first portion 10A of the container 1. The supplied toner is mingled with the magnetic carriers by a rotary mixer 61. Then, as shown in FIG. 10, the toner is sent in an Na-direction by the first screw 3A toward a first opening 20A (see arrow Q1) formed at one lower corner of the partition 2. Through this opening, the toner is supplied from the first portion 10A to the second portion 10B (see arrow Q2). Then, the toner is sent in an Nb-direction, opposite to the Na-direction, by the second screw 3B toward a second opening 20B (see arrow Q3) formed at the other lower corner of the partition 2. Through the second opening 20B, the toner returns to the first portion 10A of the container 1 (see arrow Q4).

Referring back to FIG. 9, the conveyor roller 4 and the two developer rollers 5A–5B are elongated generally in parallel to the second screw 3B. In operation, the conveyor roller 4 picks up the toner in the second portion 10B of the container 1, to pass it to the first developer roller 5A. At this time, an excessive amount of toner is scraped off the conveyor roller 4 by the first toner blade 40. Likewise, an excessive amount of toner passed onto the first developer roller 5A is scraped off by the second toner blade 50.

With the above arrangement, the toner in the second portion 10B of the container 1 is expected to be uniformly distributed along the entire length of the second screw 3B. Consequently, the toner maybe supplied to the first developer roller 5A uniformly over its entire length (and to the second developer roller 5B) via the conveyor roller 4. The excessive toner scraped off by the toner blade 40 or 50 will fall into the second portion 10B of the container 1, to be picked up again by the conveyor roller 4.

The conventional developer has been found disadvantageous in the following points.

For proper circulation of the toner within the container 1, the four toner transfer rates Q1–Q4 need to be well balanced. Unfortunately, however, the transferability of the toner tends to worsen with time (as the print count increases), which makes the toner circulation irregular In such an instance, the toner transfer rate Q4 through the second opening 20B may unduly be smaller than the toner transfer rate Q3 by the second screw 3B. As a result, an excessive amount of toner will accumulate around the second opening 20B in the second portion 10B of the container 1. Such an imbalance in toner distribution makes it impossible to supply toner uniformly over the entire length of the developer rollers 5–5B, which gives rise to the deterioration of the print quality. In addition, the accumulated toner may leak out of the container 1.

SUMMARY OF THE INVENTION

The present invention has been proposed under the circumstances described above. It is, therefore, an object of the present invention to provide a developer in which toner is uniformly distributed over the entire length of a developer roller even if the transferability of the toner deteriorates with time.

According to the present invention, there is provided a developer including: a container for holding developing material; a partition dividing the container into a first chamber and a second chamber, the partition being formed with first and second openings for causing the first and the second chambers to communicate with each other, the partition being also formed with a third opening above the second opening for introducing an excessive amount of developing material from the second chamber into the first chamber; a first screw arranged in the first chamber for transferring the developing material from the second opening to the first opening; a second screw arranged in the second chamber for transferring the developing material from the first opening to the second opening; a developer roller arranged generally in parallel to the second screw and including a cylindrical surface onto which the developing material in the second chamber is supplied; a blade arranged above the second screw for scraping off an excessive amount of developing material; and adjusting means for controlling a quantity of the developing material passing through the third opening.

According to a preferred embodiment, the adjusting means may include a movable shutter for at least partially closing the third opening. In this case, preferably, the developer may further include a memory for storing data for controlling the shutter. The data to be stored in the memory may be obtained experimentally.

Preferably, the stored data may relate to the relation between the current print condition and the operation of the shutter. An example of the current print condition is the number of the performed printing operations (which may be deduced by monitoring how many times the photosensitive drum of a printer has been rotated).

Preferably, the developer may further include a sensor for detecting the developing material adjacent to the second opening in the second chamber for output of a detection signal. In this case, the shutter may be operated based on the detection signal.

According to a preferred embodiment, the developer may further include a conveyor roller for supplying the developing material to the developer roller. In this case, the adjusting means may include an additional developing material scraping blade which is arranged adjacent to the conveyor roller and movable relative to the conveyor roller.

Preferably, the additional blade may be pivotable about a predetermined axis. As the blade is caused to pivot about the axis, the clearance between the tip of the blade and the conveyor roller can be adjusted.

Preferably, the developer may further include a memory for storing data relating to a relation between a print condition and an operation of the additional blade. In operation, the posture of the additional blade is controlled in accordance with the data.

Other features and advantages of the present invention will become apparent from the detailed description given below with reference to the accompanying drawings.

DETAILED DESCRIPTION OF THE PREFERRED EMBODIMENTS

The preferred embodiments of the present invention will be described below with reference to the accompanying drawings.

Figure 1:
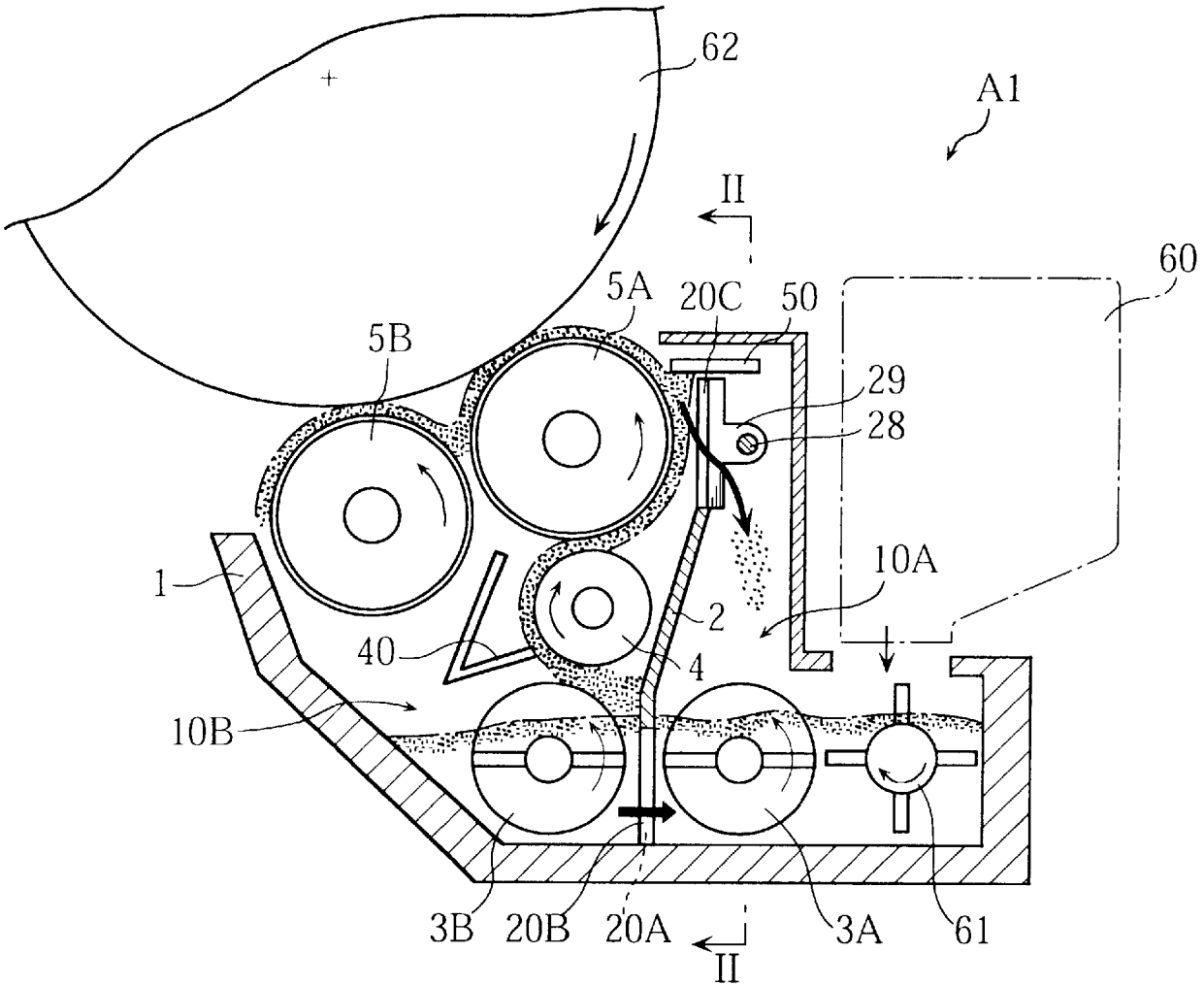
FIG. 1 is a sectional side view showing a developer according to a first embodiment of the present invention.
Figure 2:
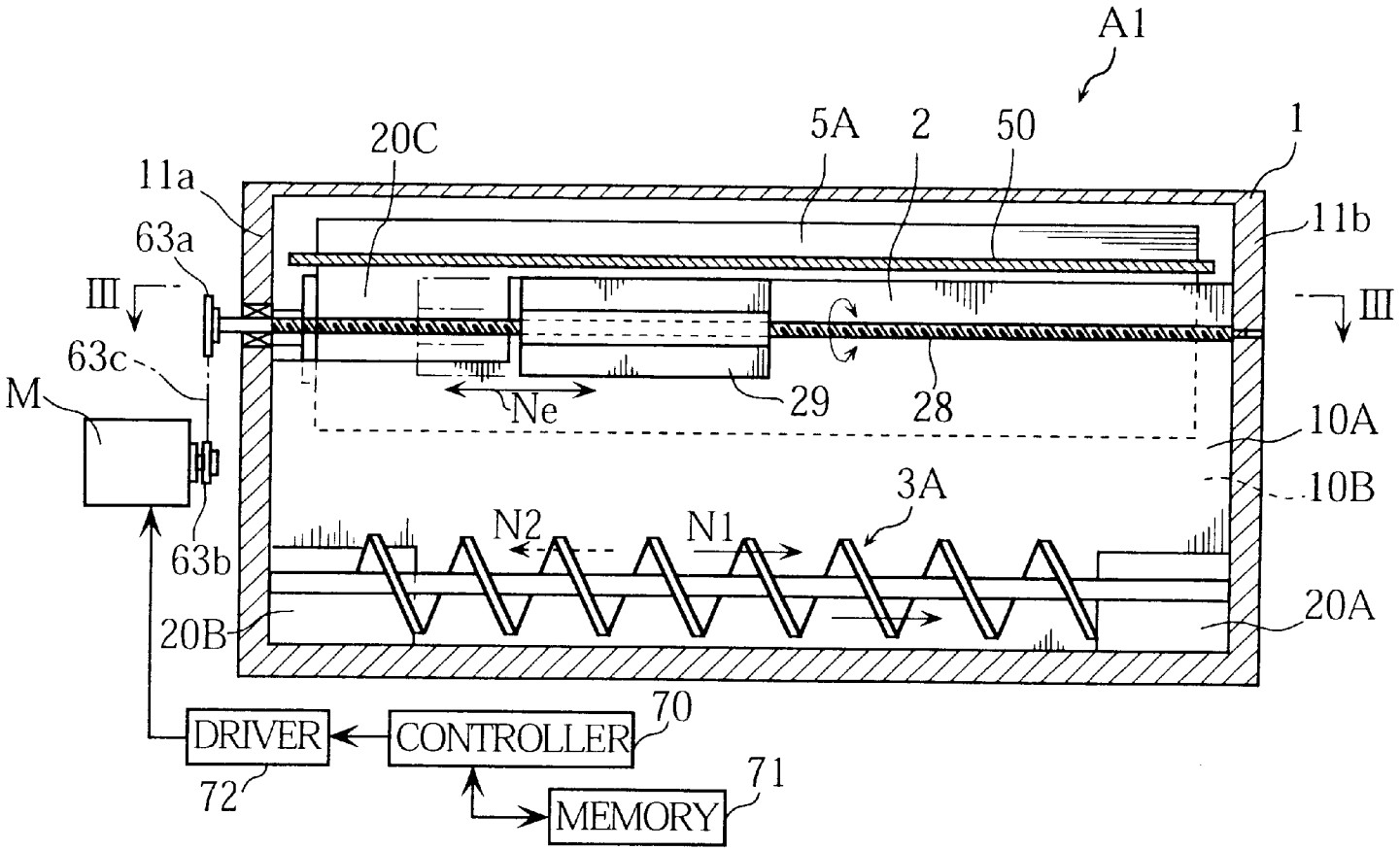
FIG. 2 is a sectional view taken along lines II—II in FIG. 1.
Figure 3:
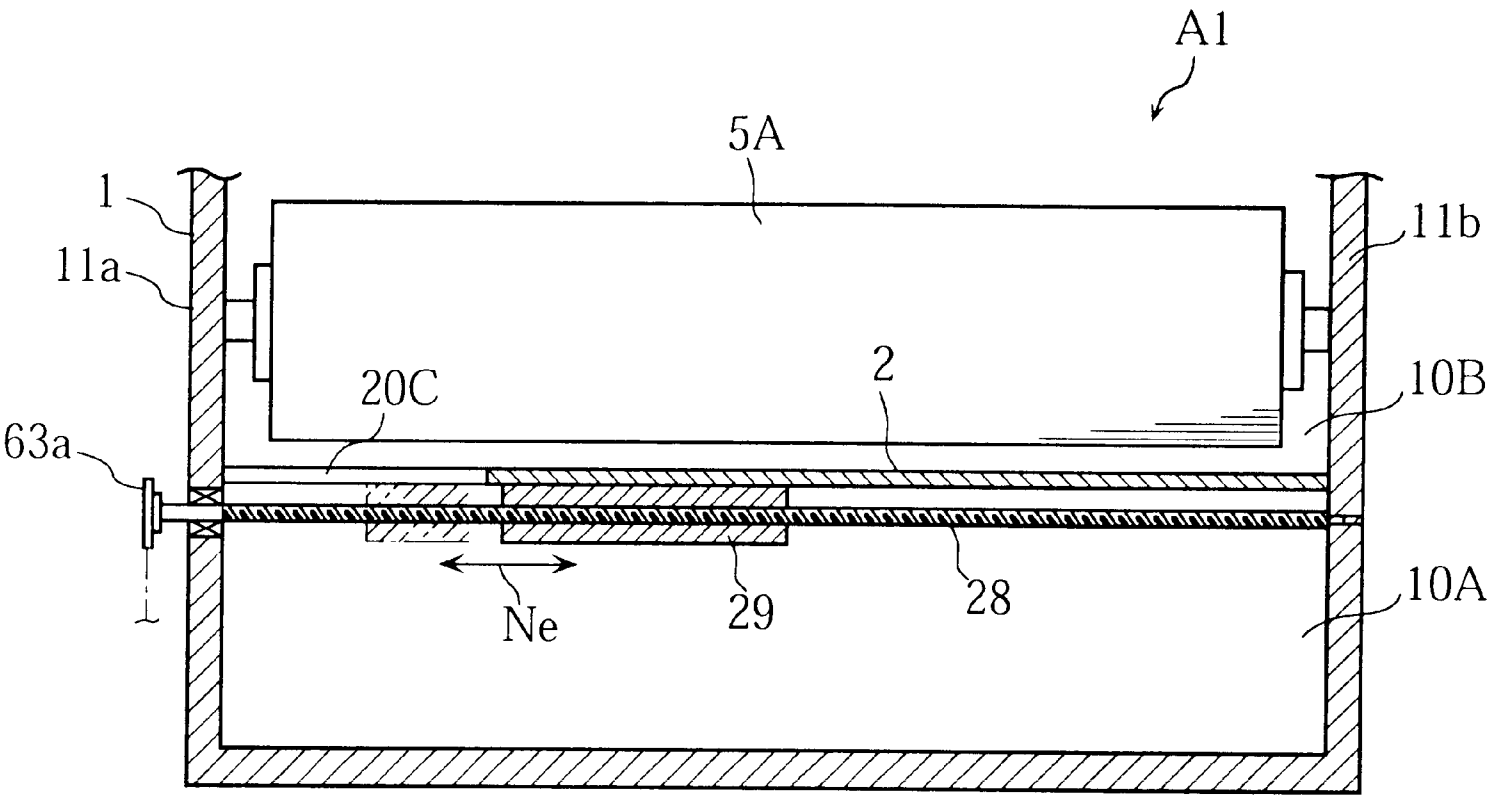
FIG. 3 is a sectional view taken along lines III—III in FIG. 2
Figure 9:
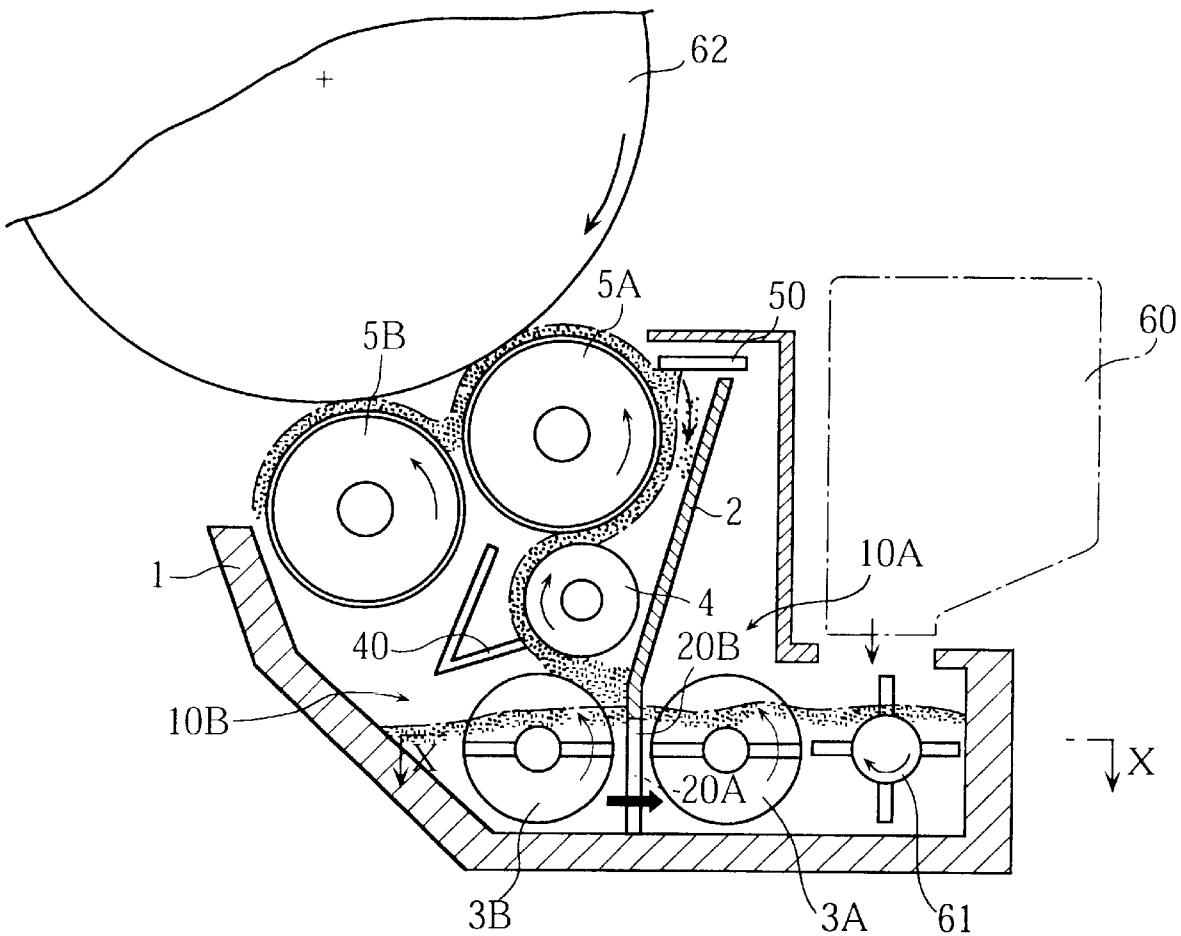
FIG.9 PRIOR ART
FIG. 9 is a sectional view showing a conventional developer.
Figure 10:
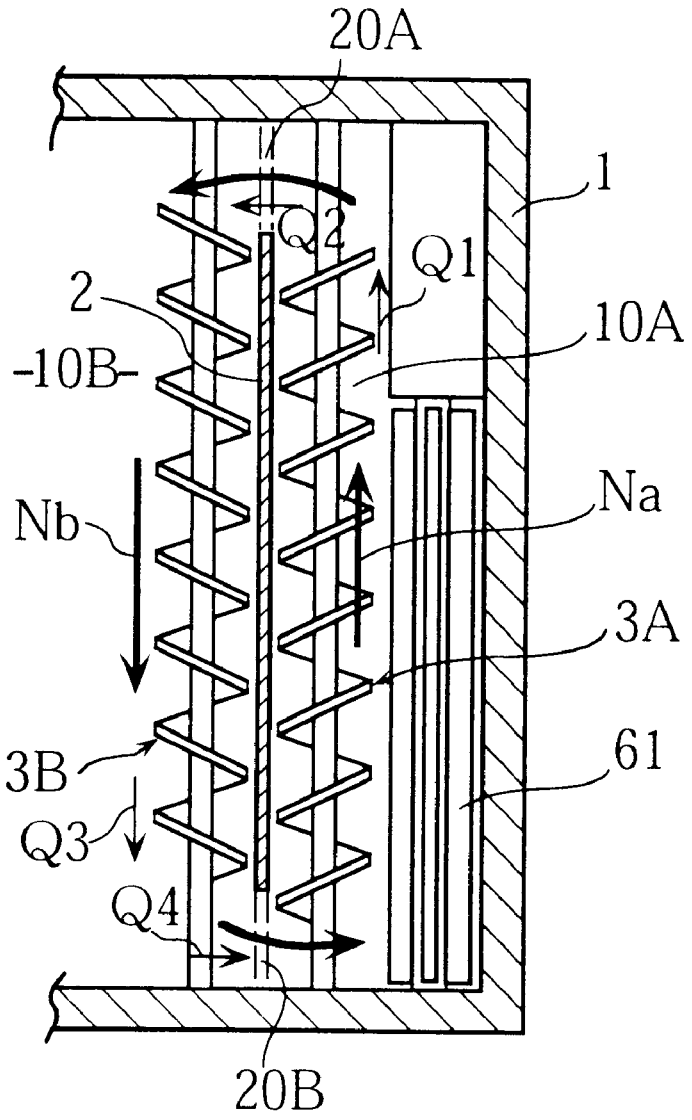
FIG.10 PRIOR ART
FIG. 10 is a sectional view taken along lines X—X in FIG. 9.

Reference is first made to FIGS. 1–3 showing a developer according to a first embodiment of the present invention. As seen from the comparison between FIG. 1 and FIG. 9, the developer Ac of the present invention and the conventional developer have many things in common. Herein below, the components of the developer Ac which are identical or similar to those of the conventional developer are indicated by the same reference numerals or signs.

Though the developer Ac of the present invention and the conventional developer are similar in many respects, there are some significant differences between them. Specifically, as best shown in FIG. 2, the partition 2 of the present invention is formed with a rectangular cutout or third opening 20C (which is not found in the conventional device), in addition to the first and the second openings 20A, 20B formed at the lower corners of the partition 2. Further, a shutter 29 is provided in the developer A1, to adjustable close the cutout 20C. The cutout 20C is formed at one of the upper corners of the partition 2 that is located above the second opening 20B. As shown in FIG. 1, the cutout 20C is disposed under the second toner blade 50, so that the excessive toner scraped off the first developer roller 5A is led into the first portion 10A of the container 1.

Of course, the cutout 20C may be disposed at a different location, as long as the excessive toner can be properly led into the first portion 10TA. In this case, the second blade 50 may also be arranged at a different location than the illustrated one in FIG. 1. For instance, the second blade 50 may be located below the first developer roller 5A, whereby an excessive amount of scraped toner is led into the first portion 10A before the toner is passed onto the first developer roller 5A from the conveyor roller 4.

The shutter 29, which is large enough to entirely close the cutout 20C, is horizontally movable, as indicated by a two-headed arrow NE in FIG. 2. To this end, the shutter 29 is supported by a horizontal, threaded shaft 28 which is rotatable connected to the opposing side walls 11*a*, 11*b* of the container 1. The shutter 29 is provided with an internally threaded through-hole into which the shaft 28 is screwed. One end of the shaft 28 is connected to a reversible motor M via a pair of pulleys 63*a*–63*b* and a connecting belt 63*c*. Upon actuating the motor M, the shaft 28 is rotated about its axis, while the shutter 29 remains unstated due to the sliding contact with the partition 2 (see FIG. 3). As a result, the shutter 29 is moved to the right or left in FIG. 2, depending on the rotating direction of the motor M. By controlling the actuation of the motor M, the horizontal displacement of the shutter 29 is adjusted, thereby closing or opening the cutout 20C in a desired manner. To this end, a driver 72, a controller 70 and a memory 71 are provided. The driver 72 is connected to the motor M and operates under the control of the controller 70. The memory 71 stores data on the number of performed print operations, and also data on the relation between the number of print operations and the suitable opening width of the cutout 20C. For instance, the opening width of the cutout 20C may be set to 100 mm when the number of performed print operations is 0–49,999, or 80 mm when the number is 50,000–99,999, or 60 mm when the number is 100,000–199,999, or 40 mm when the number is 200,000–299,999, or 20 mm when the number is 300,000-399,999, or 0 mm when the number is 400,000 or more.

The controller 70 is provided with a CPU (central processing unit). Under the control of the CPU, which operates based on the data stored in the memory 71 and the current number of print operations, the driver 72 actuates the motor M so that a desired opening width is achieved at the cutout 20C. The number of print operations may be determined by monitoring the number of rotation of the photosensitive drum 62 or the developer rollers 5A, 5B. The current number of rotation of the drum 62 or the rollers 5A, 5B may be constantly monitored, and the data regarding the rotation number is sent to the controller 70.

The function of the developer A1 will be described below.

In operation, the toner present in the first portion LOAD of the container 1 is transferred in the N1-direction (FIG. 2) by the first screw 3A. After being brought to the right end of the screw 3A, the toner is supplied to the second portion 10B of the container 1 via the first opening 20A. Then, the toner is transferred in the opposite N2-direction by the second screw 3B. After being brought to the left end of the second screw 3B, the toner is brought back to the first portion 10A via the second opening 20B (the end of one cycle of the toner circulation).

As in the conventional developer, the toner present in the second portion 10B is picked up by the conveyor roller 4 to be supplied to the developer rollers 5A and 5B, as shown in FIG. 1. With two developer rollers, the toner transfer onto the drum 62 can be reliably performed, thereby coping with high-speed printing. Of course, the present invention is applicable to a developer including only one developer roller.

An excessive amount of toner clinging to the conveyor roller 4 or first developer roller 5*a* is scraped off by the first toner blade 40 or second toner blade 50. The toner scraped from the conveyor roller 4 falls in the second portion 10B. However, the toner scraped from the first developer roller 5A will partly fall in the second portion 10B, but partly fall into the first portion 10A of the container 1 through the cutout 20C, unless the shutter 29 completely closes the cutout 20C. In this manner, the scraped toner is prevented from falling only into the second portion 10B. As a result, the unfavorable toner accumulation near the second opening 20B can be prevented.

According to the present invention, the opening width of the cutout 20C may be adjusted in accordance with the data on how many times the photosensitive drum 62 has been rotated. This is advantageous in the following points.

As stated above, the transferability of the toner along the first or second screw 3A or 3B is initially good, but will deteriorate with time. Thus, at the initial stage, the toner is transferred along the second screw 3B (and the first screw 3A as well) very smoothly, which may cause a toner accumulation at the second opening 20B. To avoid this, the cutout 20C is widely opened, so that a large part of the excessive toner scraped off the first developer roller 5A will fall into the first portion 10A of the container 1. Thus, the amount of the toner present in the second portion 10B is reduced, thereby preventing the unfavorable toner accumulation at the second opening 20B.

Conversely, after the developer A1 is used for a relatively long period of time, the toner transferability becomes worse. Consequently, the toner will not be smoothly transferred along the second screw 3B, thereby producing a toner-scarce region near the second opening 20B in the second portion 10B of the container 1. To address this problem, the cutout 20C may be partly or completely closed by the shutter 29, so that a larger part of the toner scraped off the first developer roller 5A will fall into the second portion 10B of the container 1. In this manner, the nonuniform toner distribution in the second portion 10B is avoided.

It should be noted that such a nonuniform toner distribution may be found in the first portion 10A of the container 1. However, the nonuniformity in the first portion 10A is not a problem since the conveyor roller 4 does not pick up toner from the first portion 10A. Thus, even if the toner distribution happens to be nonuniform in the first portion 10A, it is possible to maintain the high print quality when the toner distribution in the second portion 10B is uniform.

Figure 4:
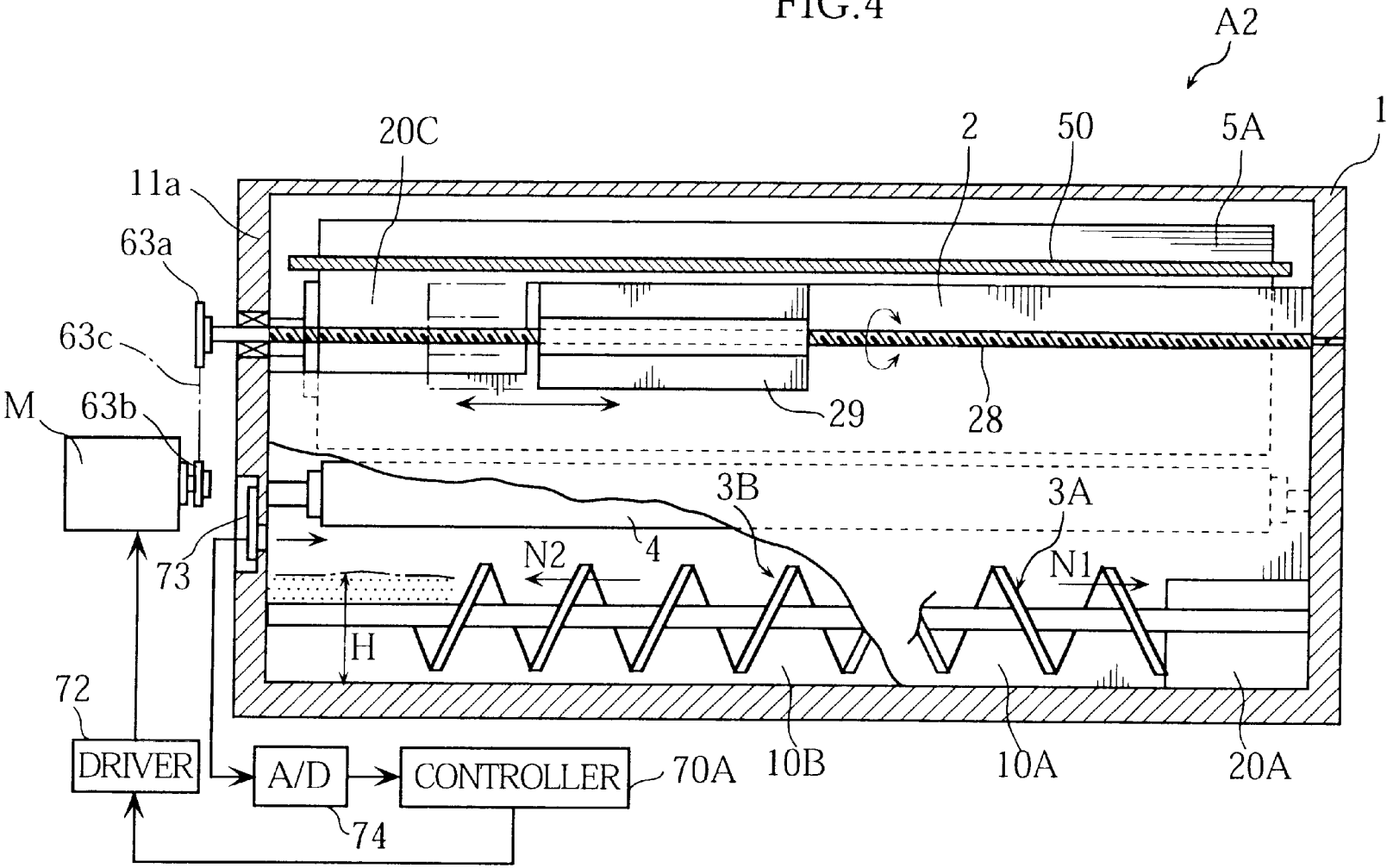
FIG. 4 is a sectional view showing a developer according to a third embodiment of the present invention.

FIG. 4 shows a developer A2 according to a second embodiment of the present invention. The developer A2 of this embodiment is basically similar to the previous developer A1, except that a toner level sensor 73 is provided in the first side wall 11*a* of the container 1. The sensor 73 outputs a detection signal when the height of the toner accumulation near the second opening 20B in the second portion 10B is over a predetermined value H. The sensor 73 may be a magnetic or optical device. A magnetic sensor may be designed to respond to the carriers of the developing material.

The detection signal outputted from the sensor 73 is supplied to a controller 70A via an A/D converter 74. Based on this detection signal, the controller 70A actuates the motor M for adjusting the position of the shutter 29. Specifically, when no detection signal is supplied to the controller 70A from the sensor 73 (i.e., when the toner accumulation is low), the shutter 29 may be brought to the left extremity position (as viewed in FIG. 4) to completely close the cutout 20C. On the other hand, when a detection signal is supplied to the controller 70A (i.e., when the toner accumulation is high), the shutter 29 may be brought to the right extremity position shown in FIG. 4, to completely open the cutout 20C.

In the illustrated embodiment, only one toner level sensor is used, though the present invention is not limited to this. Two or more sensors may be provided at different heights in the first side wall 11*a*, so that the positional adjustment of the shutter 29 can be performed more finely.

Figure 5:
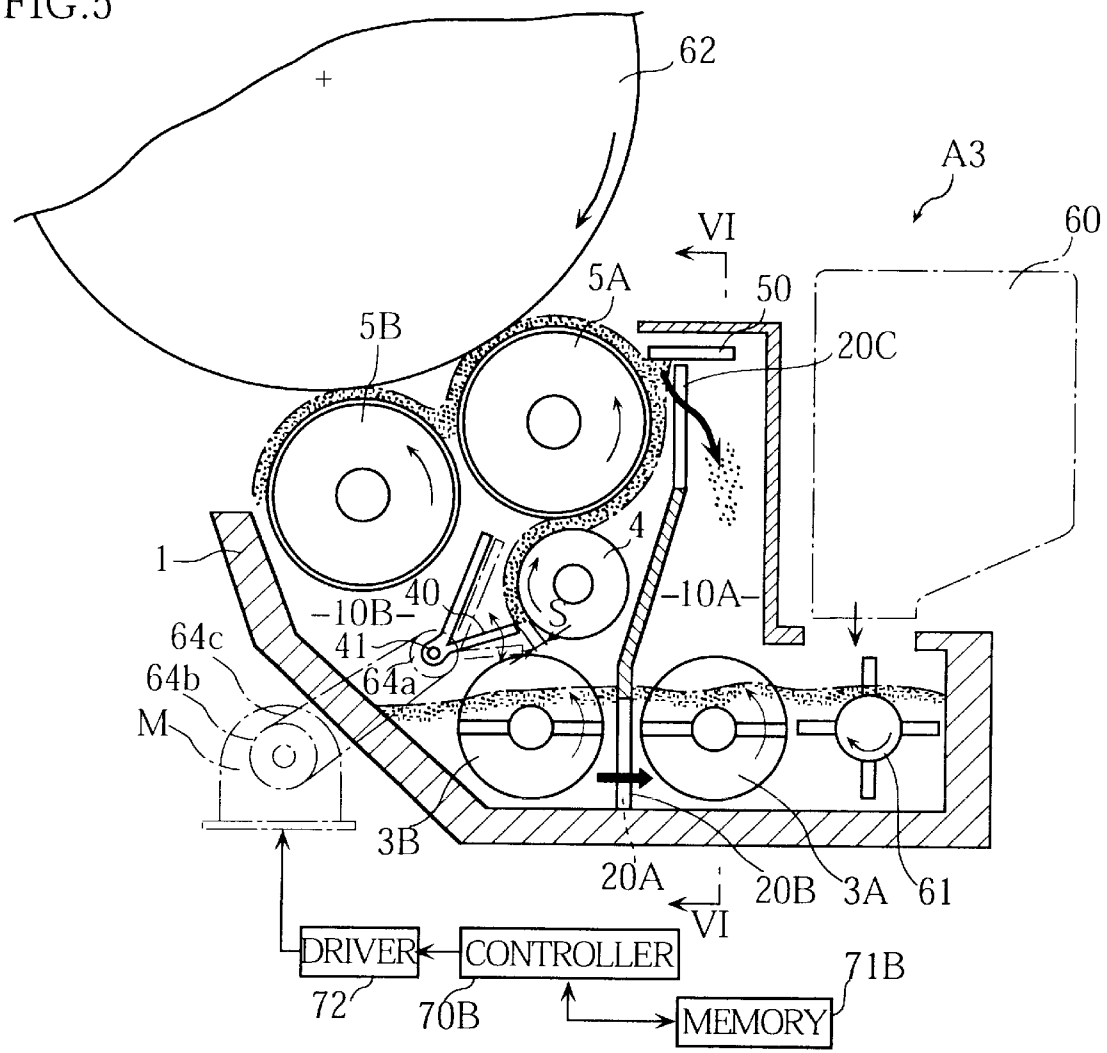
FIG. 5 is a sectional view showing a developer according to a third embodiment of the present invention.
Figure 6:
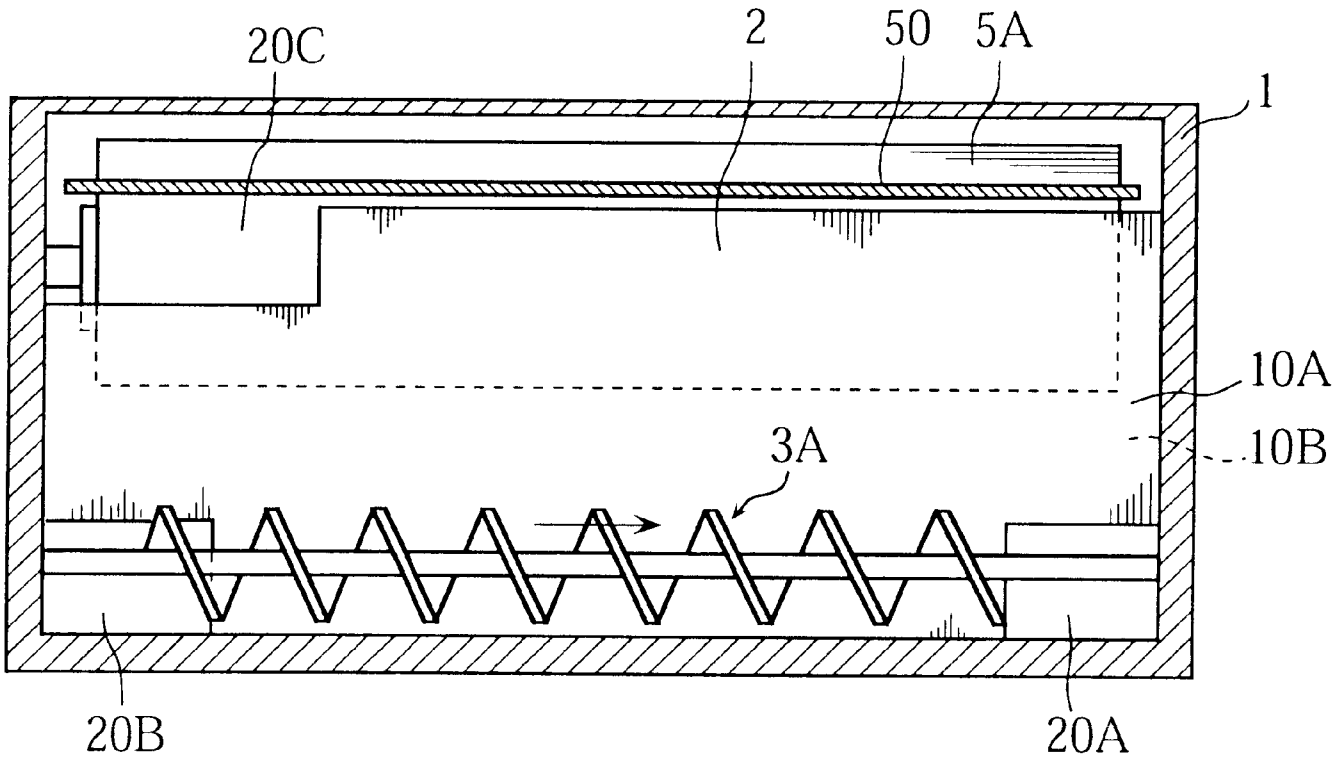
FIG. 6 is a sectional view taken along lines VI—VI in FIG. 5.

FIGS. 5 and 6 show a developer A3 according to a third embodiment of the present invention. In this embodiment, no shutter is provided at the cutout 20C, as best shown in FIG. 6. Instead, the first blade 40 is made pivotable about a horizontal shaft 41, so that the clearance S between the blade 40 and the conveyor roller 4 is variable. For actuating the blade 40, a reversible motor M is connected to the blade 40 via a pair of pulleys 64*a*–64*b* and a belt 64*c*. The operation of the motor M is controlled by a driver 72, a controller 70B and a memory 71B. The memory 71B stores data on the relation between the number of printing operations and the inclination angle of the first blade 40 (or the clearance S). Based on this data and the information about the current number of the printing operations, the controller 70B adjusts the inclination angle of the first blade 40 via the driver 72 and the motor M, so that the clearance S is set to a required value.

According to the third embodiment described above, the adjustment of the clearance S indirectly contributes to the control of the amount of the toner that is scraped off the first developer roller 5A and led into the first portion 10A via the cutout 20C. Specifically, when the clearance S is relatively small, a larger amount of toner is scraped off the conveyor roller 4, whereby a smaller amount of toner is supplied to the first developer roller 5A. Accordingly, a smaller amount of toner is scraped off the developer roller 5A by the second blade 50, which reduces the amount of toner to fall into the first portion 10A via the cutout 20C. On the contrary, when the clearance S is relatively large, a smaller amount of toner is scraped off the conveyor roller 4, whereby a larger amount of toner is supplied to the first developer roller 5A. Accordingly, a larger amount of toner is scraped off the developer roller 5A by the second blade 50, which increases the amount of toner to fall into the first portion 10A via the cutout 20C.

In the third embodiment, the clearance S is made relatively large when the number of performed printing operations is relatively small (i.e., when the toner accumulation at the second opening 20B in the second portion 10B is more likely to occur). Conversely, the clearance S is made relatively small when the number of performed printing operations is relatively large (i.e., when the toner accumulation at the second opening 20B in the second portion 10B is less likely to occur). In this manner, it is possible to equalize the toner distribution along the second screw 3B, no matter how many times the printing operations have been performed.

Figure 7:
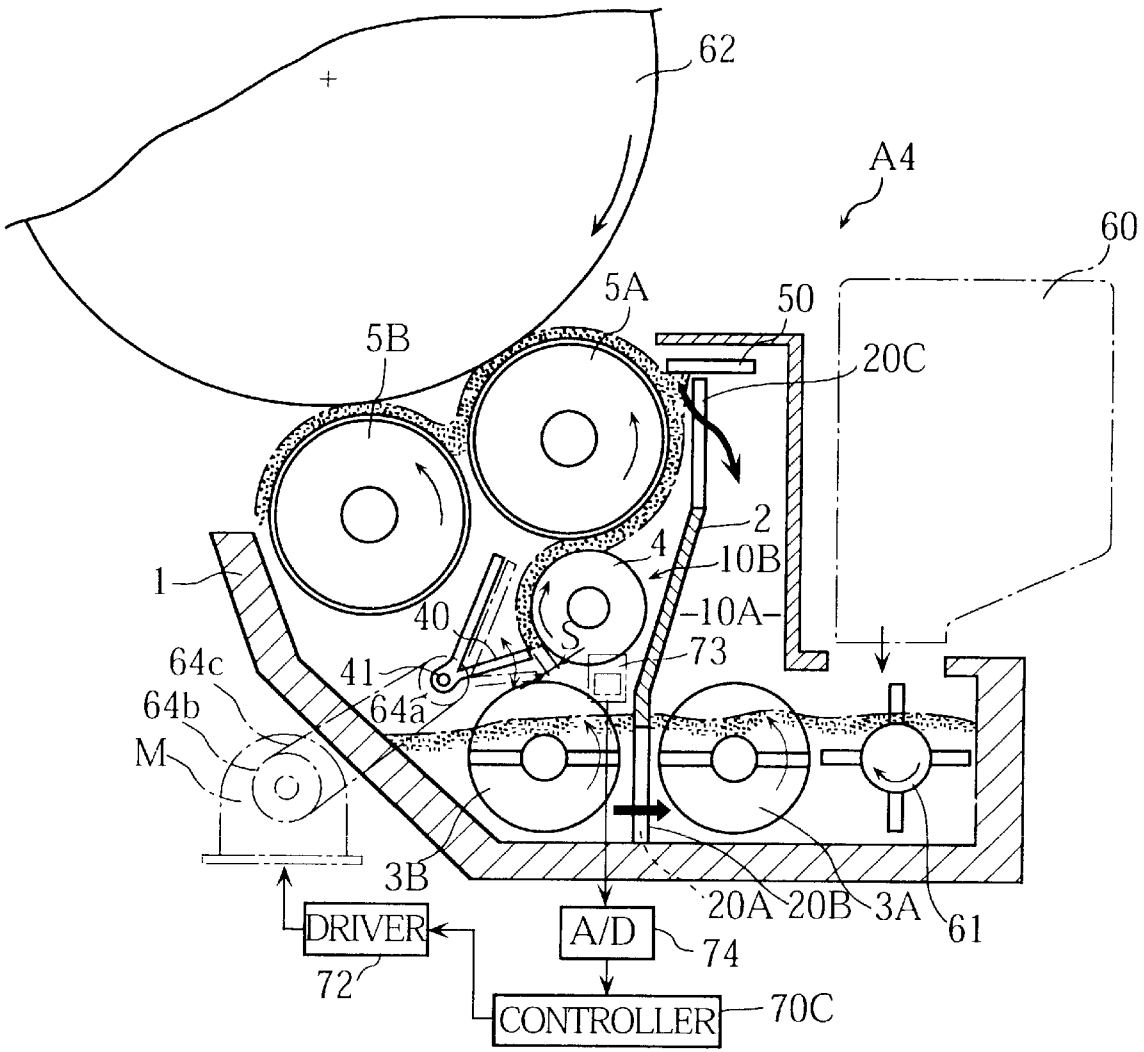
FIG. 7 is a sectional view showing a developer according to a fourth embodiment of the present invention.

FIG. 7 shows a developer A4 according to a fourth embodiment of the present invention. In this embodiment, the first blade 40 is caused to pivot by the same mechanism as in the third embodiment (FIG. 5). In addition, the developer A4 is provided with a toner level sensor 73 for determining whether or not the toner accumulation near the second opening 20B in the second portion 10B is over a predetermined level. A detection signal from the sensor 73 is supplied to a controller 70C via an A/D converter 74. When no detection signal is supplied to the controller 70C, the clearance S is made relatively small, so that a larger amount of toner scraped off the conveyor roller 4 or first developer roller 5A will remain in the second portion 10B of the container 1. Conversely, when a detection signal is supplied to the controller 70C, the clearance S is made relatively large, so that a larger amount of toner scraped off the developer roller 5A will fall into the first portion 10A via the cutout 20C.

Figure 8:
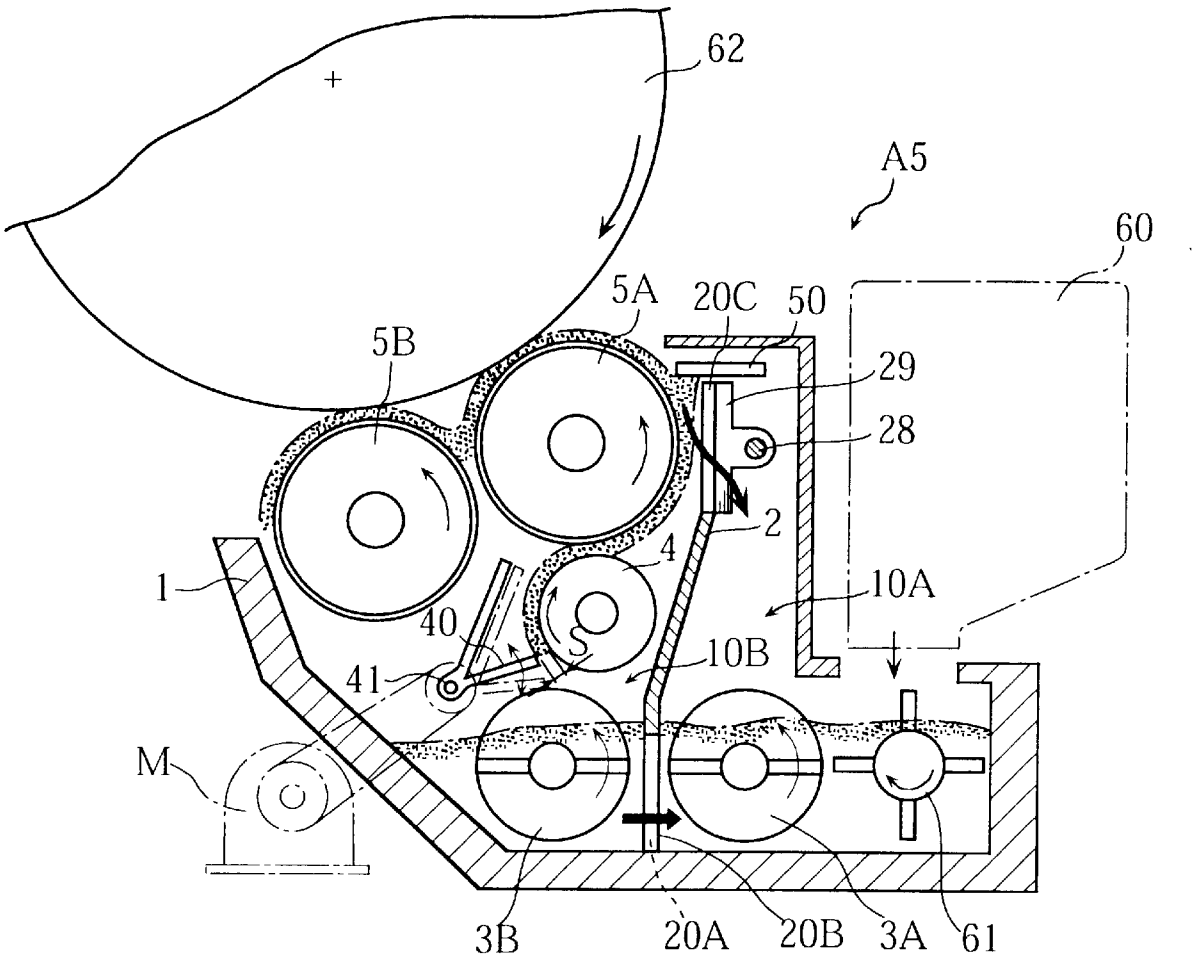
FIG. 8 is a sectional view showing a developer according to a fifth embodiment of the present invention.

FIG. 8 shows a developer A5 according to a fifth embodiment of the present invention. In this embodiment, use is made of both a pivotable first blade 40 and a horizontally movable shutter 29 for adjustable closing the cutout 20C of the partition 2. In this manner, synergistic effects by a combination of the blade 40 and the shutter 29 are expected. Thus, the amount of toner scraped off the second blade 50 and led into the first portion 10A can be adjusted more finely.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A developer comprising:

a container for holding developing material;

a partition dividing the container into a first chamber and a second chamber, the partition being formed with first and second openings for causing the first and the second chambers to communicate with each other, the partition being also formed with a third opening above the second opening for introducing an excessive amount of developing material from the second chamber into the first chamber;

a first screw arranged in the first chamber for transferring the developing material from the second opening to the first opening;

a second screw arranged in the second chamber for transferring the developing material from the first opening to the second opening;

a developer roller arranged generally in parallel to the second screw and including a cylindrical surface onto which the developing material in the second chamber is supplied;

a blade arranged above the second screw for scraping off an excessive amount of developing material; and adjusting means for controlling a quantity of the developing material passing through the third opening.

2. The developer according to claim 1, wherein the adjusting means includes a movable shutter for at least partially losing the third opening.

3. The developer according to claim 2, further comprising a memory for storing data for controlling the shutter.

4. The developer according to claim 3, wherein the stored data relates to a relation between a print condition and an operation of the shutter.

5. The developer according to claim 2, further comprising a sensor for detecting the developing material adjacent to the second opening in the second chamber for output of a detection signal, the shutter being operated based on the detection signal.

6. The developer according to claim 1, further comprising a conveyor roller for supplying the developing material to the developer roller, wherein the adjusting means includes an additional blade arranged adjacent to the conveyor roller and movable relative to the conveyor roller.

7. The developer according to claim 6, wherein the additional blade is pivotable about a predetermined axis.

8. The developer according to claim 6, further comprising a memory for storing data relating to a relation between a print condition and an operation of the additional blade, the additional blade being operated based on the data.

9. The developer according to claim 6, further comprising a sensor for detecting the developing material adjacent to the second opening in the second chamber for output of a detection signal, the additional blade being operated based on the detection signal.

10. The developer according to claim 6, further comprising a movable shutter for at least partially closing the third opening.

* * * * *